United States Patent [19]

Stahlecker

[11] Patent Number: 4,590,757

[45] Date of Patent: May 27, 1986

[54] FEEDING AND OPENING DEVICE FOR AN OPEN-END SPINNING MACHINE

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 794,408

[22] Filed: Nov. 4, 1985

[30] Foreign Application Priority Data

Nov. 8, 1984 [DE] Fed. Rep. of Germany ..... 3440816

[51] Int. Cl.[4] ..... D01H 7/892; D01H 7/895; D01H 7/885

[52] U.S. Cl. ..... 57/412; 19/105; 57/301; 57/407; 57/408

[58] Field of Search ..... 57/401, 406, 407, 408, 57/409–413, 301, 302; 19/98, 99, 105, 115 R

[56] References Cited

U.S. PATENT DOCUMENTS

| | | | |
|---|---|---|---|
| 3,938,310 | 2/1976 | Didek et al. | 57/412 |
| 4,008,562 | 2/1977 | Vecera et al. | 57/412 |
| 4,014,162 | 3/1977 | Stahlecker | 57/413 |
| 4,024,699 | 5/1977 | Goldammer et al. | 57/408 X |
| 4,050,228 | 9/1977 | Landwehrkamp et al. | 57/412 |
| 4,055,942 | 11/1977 | Stahlecker | 57/412 X |
| 4,201,037 | 5/1980 | Artzt et al. | 57/301 |
| 4,251,984 | 2/1981 | Ripka et al. | 57/412 |
| 4,459,801 | 7/1984 | Stahlecker et al. | 57/412 |

*Primary Examiner*—John Petrakes
*Attorney, Agent, or Firm*—Barnes & Thornburg

[57] ABSTRACT

A feeding and opening device for open-end spinning machines is disclosed with a feeding table cooperating with a feeding roller and containing a fiberbeard support that is opposite the opening roller. The feeding table with fiberbeard support is held so that it can be swivelled from its operating position into a cleaning position. The swivelling can be carried out manually or by means of an adjusting element of an automatic servicing device. By means of the swivelling-away of the feeding table, the support surface of the fiberbeard support is exposed so that it can be cleaned in order to remove sticky components, such as honey dew or similar components.

19 Claims, 9 Drawing Figures

12
1
805
15
807
817
849
10
11
825
821
846
848
847

12
904
903
1
2
952
15
905
950
907
918
11
10
951
925

FEEDING AND OPENING DEVICE FOR AN OPEN-END SPINNING MACHINE

BACKGROUND AND SUMMARY OF THE INVENTION

This invention relates to a feeding and opening device for an open-end spinning machine having a feeding roller which, cooperating with a sliver loading part that is elastically pressed against it, forms a clamping gap for a sliver that is to be fed to an opening roller. The end of the sliver which assumes the shape of a fiberbeard by being combed out by means of the opening roller, is assigned a fiberbeard support equipped with a support surface that is opposite the circumference of the opening roller, the fiberbeard support being mounted at the sliver loading part.

Feeding and opening devices of the initially mentioned type as they are known, for example, on the basis of German Patent (DE-PS) No. 24 51 551, during the spinning of cotton, are subject to the formation of deposits on the fiberbeard support surface consisting primarily of sticky components, in particular, honey dew and cotton wax. It seems that the deposits of these sticky dirt components have increased in recent times. Since it cannot be expected that future cotton crops will be improved in this respect, an increase of this problem may be expected. In order to prevent a deterioration of the spun yarn, it is today necessary in some spinning mills that the fiberbeard supports are cleaned once a week. This work that must be carried out manually is awkward and unreliable. Since the fiberbeard support surface is assigned to the opening roller and only has a very short distance from it, it is necessary in most cases to remove the sliver loading part or the opening roller in order to make this fiberbeard support surface accessible. The removal of the opening roller which in most cases is simpler than the removal of the sliver loading part always results in the danger that in the process the sensitive fitting of the opening roller is damaged.

This invention is based on the objective of developing a feeding and opening device of the initially mentioned type in such a way that a simple cleaning of the fiberbeard support is possible without carrying out assembly work at the feeding and opening device.

This objective is achieved according to the invention by providing an arrangement wherein the sliver loading part together with the fiberbeard support can be moved away from the opening roller in a guide from its operating position into a cleaning position in which the fiberbeard support surface is accessible to a cleaning element.

As a result, it is possible to expose the support surface of the fiberbeard support for a cleaning, in which case the sliver loading part remains in its guide so that no assembly work is necessary and the return to the exact operating position is ensured. In the cleaning position, the fiberbeard support surface is not only easy to reach but can also be inspected so that a reliable cleaning can be carried out.

In an advantageous development of certain preferred embodiments of the invention, it is provided that the sliver loading part is pivoted around a swivel shaft that is in parallel to the shaft of the feeding roller, and that the pivoting angle between the operating position and the cleaning position swivelled away from the feeding roller and the opening roller is about 90°. This cleaning position is sufficiently far away from the opening roller so that, on the one hand, the support is easily accessible and, on the other hand, the danger of a damaging of the fitting of the opening roller by a cleaning tool is avoided.

In a further advantageous development of certain preferred embodiments of the invention, it is provided that the spring for the sliver loading part is supported and coupled to the sliver loading part in such a way that, during the pivoting between the operating position and the cleaning position, it passes through a dead center position. This results in the advantage that the spring of the sliver loading part secures this sliver loading part also in the cleaning position so that it does not have to be held fast during the cleaning.

In a further development of preferred embodiments of the invention, a wall is provided in the transport direction of the fiber material after the fiberbeard support, this wall being opposite the circumference of the opening roller and being held so that it can be moved away from the opening roller. In the case of some embodiments of feeding and opening rollers, this type of wall is required in order to ensure a suitable air flow in the area of the opening roller. In order not to impair by means of a wall the guiding of the sliver loading part with the fiberbeard support from the operating position into the cleaning position and back to the operating position, this wall is also moved away. In the case of an advantageous development, it is provided in this case that the wall is mounted at the sliver loading part and together with it can be moved away from the opening roller. The servicing process is therefore not made more complicated.

In a further development of preferred embodiments of the invention at least one stationary cleaning element is provided which is arranged in the path of movement of the support surface of the fiberbeard support that can be moved from the operating position to the cleaning position. In the case of this development during the guiding of the sliver loading element with the fiberbeard support from the operating position into the cleaning position and back, a cleaning is carried out automatically at the cleaning element.

In a further development of preferred embodiments of the invention, an automatic servicing apparatus is provided which contains an adjusting element that can be applied to the sliver loading part. As a result, the cleaning of the fiberbeard support surface is at least partially automated.

In a further development of the invention, it is provided that the automatic servicing apparatus is equipped with at least one cleaning element that can be applied to the fiberbeard support surface when located in the cleaning position. As a result, a fully automatic cleaning is achieved so that the same cleaning effect is always ensured irrespective of the care of an operating person.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
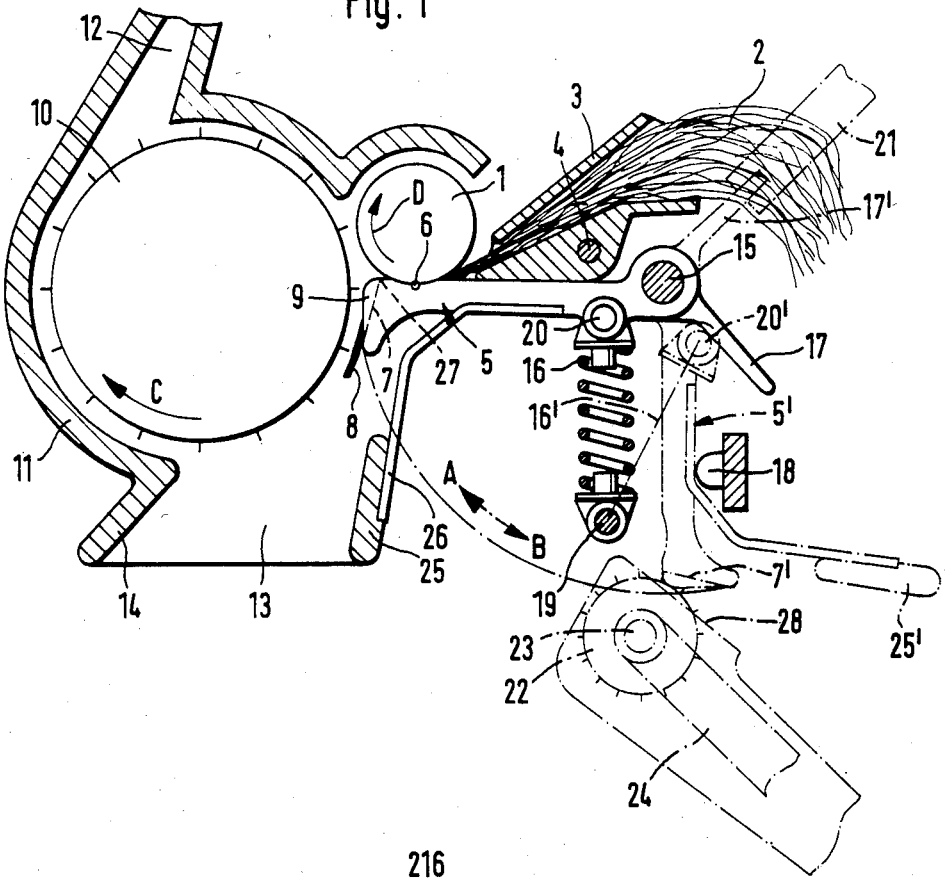
FIG. 1 is a schematic partial sectional view of a feeding and opening device constructed according to a preferred embodiment of the invention and having a weighting spring for the sliver loading part passing a dead center position between the operating position and the cleaning position.

The embodiment of a feeding and opening device according to FIG. 1 contains a feeding roller 1 which, via a drive that is not shown is driven in the direction of the Arrow D. A sliver loading part 5 cooperates with the feeding roller 1, the sliver loading part 5 being constructed as a feeding table. The feeding table 5 can be swivelled around a swivel shaft 15 that is in parallel to the feeding roller 1, and by means of a weighting or biasing spring 16, is pressed against the circumference of the feeding roller 1. In the pressed-on area, the feeding table 5 has a partially cylindrical indentation 6 that has a slightly larger radius than the feeding roller 1. A sliver 2 to be spun is guided via a feeding hopper 3 into the area between the feeding roller 1 and the feeding table 5. The feeding hopper 3 rests on the feeding table 5 and can be swivelled around a shaft 4 that is parallel to the swivel shaft 15. The feeding roller 1 advances the placed sliver 2 to an opening roller 10.

The opening roller 10, the shaft of which extends in parallel to the feeding roller 1, is housed in an opening roller housing 11 which narrowly surrounds the circumference of the opening roller 10 over a large part of the circumference area. The opening roller 10, the circumference of which is equipped with a fitting of needles or teeth, combs out the sliver 2 and opens it up into individual fibers. Via a fiber feeding duct 12 connecting approximately tangentially to the circumference of the opening roller 10, the individual fibers are transported to a yarn forming point such as a spinning rotor of an open-end rotor spinning machine. The sliver 2 is deflected from the fitting of the opening roller 10 via a deflecting edge 27 of the feeding table 4 and combed out to a fiberbeard 8. The fiberbeard 8 is supported by a fiberbeard support 7 which has a supporting surface extending essentially tangentially to the fitting of the opening roller 10. This supporting surface is laterally bordered by lateral guides 9. The opening roller 10 turns at a much higher speed than the feeding roller 1.

In transport direction, the fiberbeard support 7 is followed by a dirt removal opening 13, through which the dirt components from the combed-out fiberbeard 8 are removed. The dirt removal opening 13 is bordered by a wall 14 of the opening roller housing 11 in transport direction which corresponds to the rotating direction C of the opening roller 10. On the opposite side, the removal opening 13 is bordered by a wall 25 which at a distance is opposite the opening roller 10 and is provided especially for the control of the air flow occurring in the area of the opening roller 10.

In practice, it should be pointed out that sticky deposits, especially of honey dew and cotton wax during the spinning of cotton, are formed on the support surface of the fiberbeard support 7 facing the circumference of the opening roller 10. In order for the spinning conditions not to deteriorate, it is necessary from time to time to clean this support surface of the fiberbeard support 7. In order to be able to carry out this type of cleaning in a simple way, it is provided that the feeding table 5 with the fiberbeard support 7 can be swivelled from the shown operating position into the cleaning position 5′ shown by the interrupted line. The swivelling of the feeding table 5 away from the feeding roller 1 and the opening roller 10 takes place around the swivel shaft 15 against the force of the spring 16. The spring 16 is coupled to a bolt 20 projecting laterally from the feeding table 5, said bolt 20 being located between the swivel shaft 15 and the feeding roller 1. The stationary counterbearing 19 and the position of the bolt 20 are chosen in such a way that, when the feeding table 5 is swivelled from its operating position to its cleaning position 5′, the spring 16 passes through a dead center position and subsequently takes up the position indicated by the interrupted line 16′. The bolt 20, during this swivel movement which amounts to about 90°, passes through the connecting plane between the swivel shaft 15 and the counterbearing 19. In the cleaning position 5′, the feeding table 5 rests against the stationary stop 18, against which it is held by the force of the spring 16 which acts in the direction of the dash-dotted line 16′ to the bolt 20 located in the dash-dotted position 20′.

At the receiving point for the swivel shaft 15, the feeding table 5 is equipped with a gripping bracket 17 which, for the swivelling of the feeding table 5, is gripped in the direction of the Arrows A and B. In this case, the swivelling may take place manually by an operator. In the cleaning position 5′, the support surface of the fiberbeard support 7 which is then in position 7′ will then be easily accessible to a cleaning tool.

Preferably, it is provided that the swivelling of the feeding table 5 as well as the cleaning of the support surface of the fiberbeard support 7 take place by means of an automatic servicing device. The automatic servicing device is preferably a component of a servicing apparatus that can be moved along a spinning machine and can be applied to individual spinning units, the spinning machine having a plurality of feeding and opening devices of this type. The servicing device is equipped with an adjusting element 21 that is only outlined and can be applied to the gripping bracket 17 and by means of a swivelling of the gripping bracket 17 into the dash-dotted position 17' swivels the feeding table 5 into its cleaning position 5'.

The servicing apparatus is also equipped with a cleaning device which can be applied in the cleaning position 5' of the support surface of the fiberbeard support 7', this cleaning device being dash-dotted in FIG. 1. This cleaning device contains a cleaning brush 22 arranged on an arm 24, which cleaning brush 22 is driven around its axis to perform rotations. In the case of the shown embodiment, the arm 24 with the cleaning brush 22 is arranged inside a suction nozzle, the suction opening 28 of which aims at the support surface of the fiberbeard support 7. After the termination of the cleaning, the cleaning brush 22 with the suction nozzle 28 is again moved away from the feeding table 5 located in the cleaning position 5', after which this feeding table 5 is again swivelled back into its operating position in the direction of the Arrow A. The cleaning brush 22 and the suction nozzle 28 are advantageously constructed in such a way that they clean not only the support surface of the fiberbeard support 7, but also connecting areas, such as the deflecting edges 27 and the lateral guides 9.

In the case of the embodiment according to FIG. 1, it is provided that the wall 25 is mounted at the feeding table 5 by means of a holder 26. The web-type holder 26 is developed in such a way that it does not impair incoming air between the fiberbeard support 7 and the end of the wall 25 facing it. Since the wall 25 is taken along when guiding the feeding table 5 from its operating position to its cleaning position 5', the arrangement and construction of the wall 25 is almost arbitrary, i.e., it may also be located in the swivel area of the feeding table 5 and the fiberbeard support 7 mounted on it.

Figure 2:
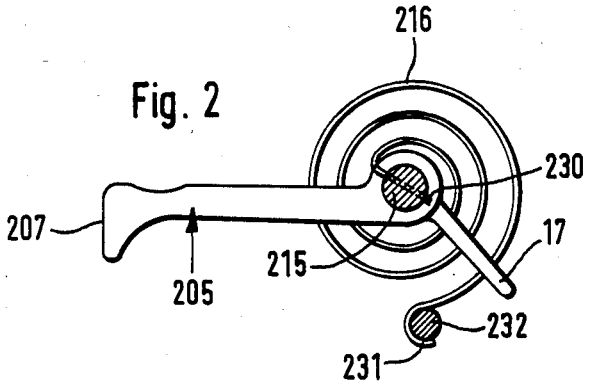
FIG. 2 is a schematic view of a sliver loading part of a device similar to FIG. 1 having a biasing spring that is developed as a spiral spring.

FIG. 2 shows only a feeding table 205 which in its construction and arrangement corresponds to the principle of the embodiment according to FIG. 1. The feeding table 205 of the embodiment according to FIG. 2, in a rotationally stable manner, is connected with its swivel shaft 215 at which the end 230 of a spiral spring 216 is fastened. The other end 231 of the spiral spring 216 is fastened at a bolt 232 which, at the same time, serves as the stop for the limiting of the swivelling-away movement of the feeding table 205, i.e., for defining the cleaning position of this feeding table 205. The spiral spring 216 has a flat sloped characteristic spring curve so that in the case of a swivel movement between the operating position and the cleaning position in a range of about 90°, the spring forces change only insignificantly.

Figure 3:
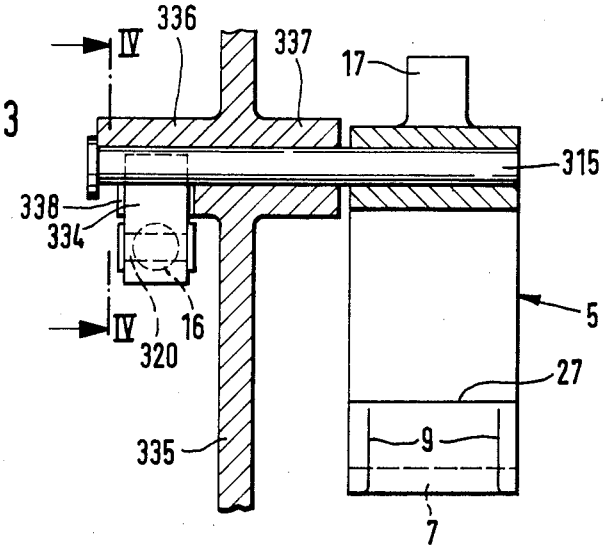
FIG. 3 is a schematic partial sectional view of a sliver loading part of an arrangement similar to FIG. 1 if taken along a plane perpendicular to the plane of FIG. 1 and showing another preferred embodiment of the invention.
Figure 4:
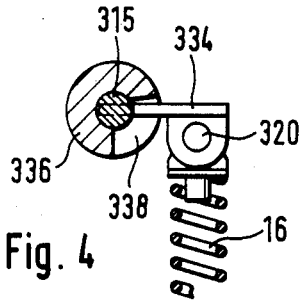
FIG. 4 is a schematic sectional view along the line IV—IV of FIG. 3.

FIGS. 3 and 4 show a modification of the embodiment according to FIG. 1, where a spring 16 is also provided which passes through a dead center position between the operating position and the cleaning position of the feeding table 5 and thus secures the feeding table 5 in the operating as well as in the cleaning position. In the case of this embodiment, the feeding table 5 is connected with the swivel shaft 315 in a rotationally stable manner. The swivel shaft 315 is pivoted in a sleeve-type projection 336, 337. The sleeve-type projection 336 and 337 is located on both sides of a separating wall 335 which is arranged between the feeding table 5 and the spring 16. The spring 16, via a hinge 320, is connected with a plate-shaped lever 334 which is fitted into the swivel shaft 315. The part 336 of the sleeve-type projection 336, 337 is equipped with a recess 338 which takes up an area of about 90° and the edge of which is used as a stop for limiting the swivelling-away movement when the feeding table 5 is swivelled into the cleaning position. The wall 335 separates the feeding table 5 from the spring 16 so that the spring is protected against flying fibers.

Figure 5:
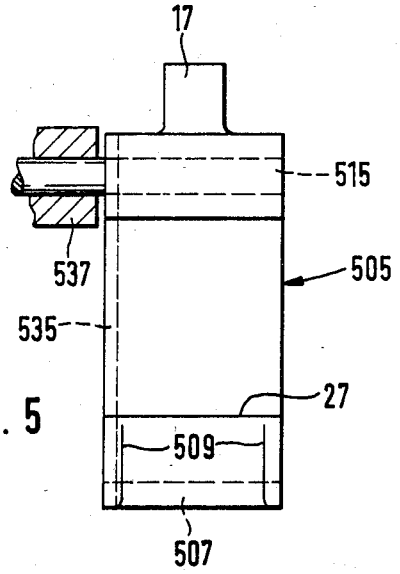
FIG. 5 is a view similar to FIG. 3 and showing another preferred embodiment of a sliver loading part.

The embodiment according to FIG. 5, compared to the embodiment according to FIGS. 3 and 4 is modified by the fact that the feeding table 505 which, in a rotationally stable manner, is connected with its swivel shaft 515 disposed in a projection 537, is equipped with a separating wall 535 that is laterally mounted on it.

Figure 6:
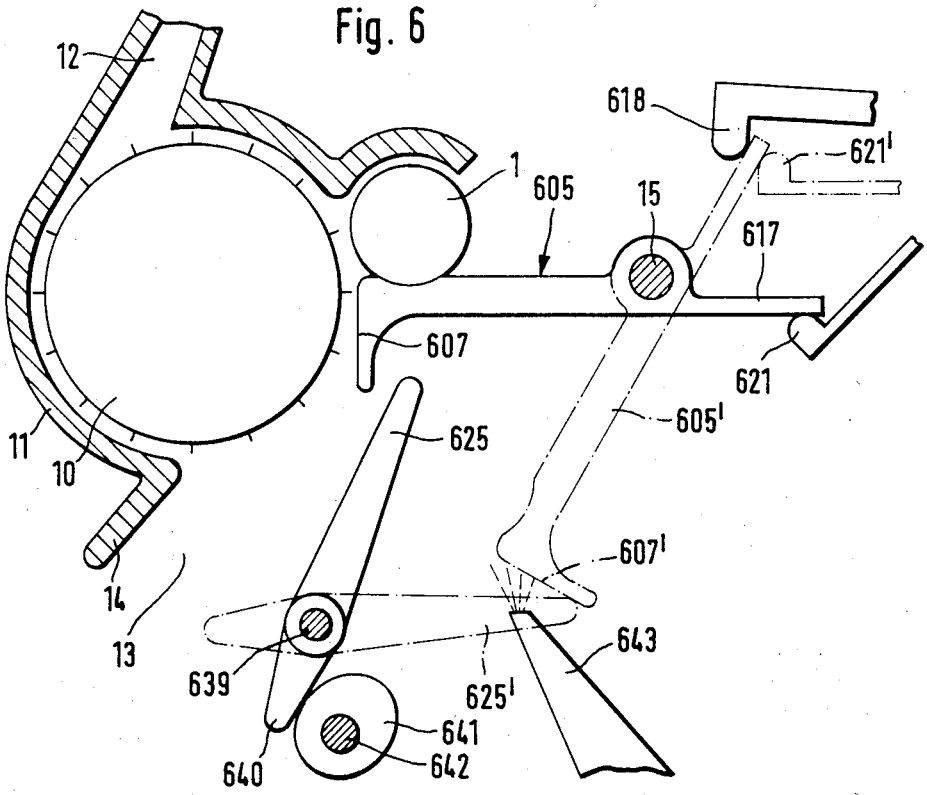
FIG. 6 is a schematic partial sectional view of a feeding and opening device having a pivoted wall that follows the fiberbeard support in transport direction, constructed in accordance with another preferred embodiment of the invention.

In the case of the embodiment according to FIG. 6, a feeding table 605 is shown that is equipped with a spring corresponding to the embodiment according to FIG. 1 or FIG. 2 or FIGS. 3 and 4. The embodiment according to FIG. 6 differs essentially from the embodiment according to FIG. 1 because of the fact that a wall 625 arranged in the area of the removal opening 13 projects into the swivel area of the feeding table 605 equipped with a fiberbeard support 607. This wall 625 is pivoted around a stationary shaft 639. The wall 625, by means of a spring that is not shown, is pressed with a projection 640 against an adjustable eccentric 641 that can be swivelled around a shaft 642 in such a way that the wall 625 can be moved into the dash-dotted position 625' from the swivel area of the feeding table 605. In the case of a swivelling, the feeding table 605 with its fiberbeard support 607 takes along the wall 625.

In the case of the embodiment according to FIG. 6, it is also provided that an adjusting element 621 of an automatic servicing device can be applied to the gripping bracket 617 of the feeding table 605 and can be swivelled with it into its servicing position 621'. The swivelling movement is limited by a stop 618 which in this case is also a component of the automatic servicing device and which is applied in the swivelling area of the gripping bracket 617. The automatic servicing device contains a spraying nozzle 643 which can be applied to the fiberbeard support 607 located in the cleaning position 607' and which sprays a cleaning fluid onto the areas to be cleaned, in particular, the support surface of the fiberbeard support 607. In addition, the automatic servicing device can also be equipped with the cleaning elements of the embodiment according to FIG. 1.

Figure 7:
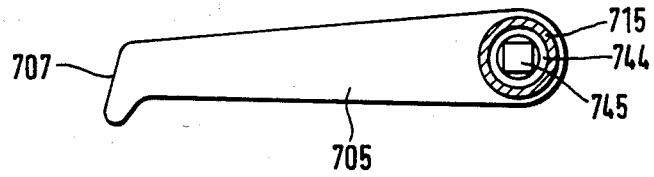
FIG. 7 is a lateral schematic view of a sliver loading part having a swivel shaft that is developed as a driving element for a catch of an adjusting element of a servicing apparatus according to another preferred embodiment of the invention.

In the case of the embodiment according to FIG. 7, a feeding table 705 that is used as the sliver loading part and is equipped with a fiberbeard support 707 is connected with a swivel shaft 715 in a rotationally stable manner, this swivel shaft being constructed as a hollow shaft. The hollow swivel shaft 715 is equipped with a funnel-shaped inlet area 744 leading to an internal square 745. An adjusting element of a servicing device that is not shown which has a corresponding external square can be applied to this hollow swivel shaft 715, said adjusting element, during the application, centering itself at the funnel-shapped inlet area 744 at the hollow shaft 715.

Figure 8:
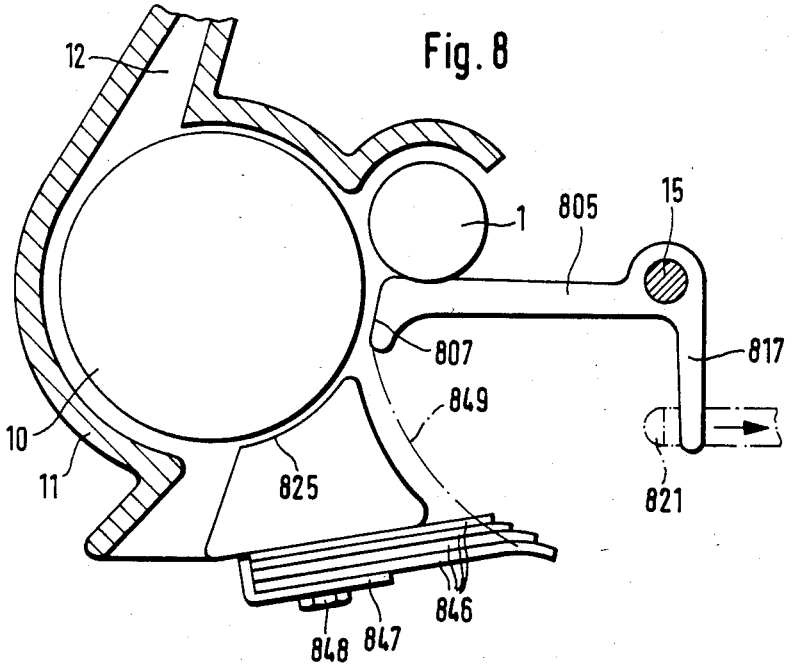
FIG. 8 is a schematic partial sectional view of a feeding and opening device constructed in accordance with another preferred embodiment of the invention and having a cleaning element that is arranged stationarily in the swivel area of the fiberbeard support.

In the case of the embodiment according to FIG. 8, a stationary wall 825 is provided in transport direction of the fiber material behind the feeding table 805 which has a fiberbeard support 807. A cleaning element 846 is fastened at the stationary wall 825, this cleaning element 846 including several elastic cleaning lips which, by means of a holder 847 and a screw 848, are fastened at the wall 825. The ends of the exchangeable elastic cleaning lips of the cleaning element 846 that are located above one another project into the swivel area 849 of the support surface of the fiberbeard support 807.

The feeding table 805 which in a manner that is not shown in detail, is loaded by a biasing spring 16 or 216 corresponding to FIG. 1 or 2 or 3, 4, also has a gripping bracket 817 by means of which it can be swivelled into its cleaning position manually or by an adjusting element 821 of an automatic servicing device. In this case, the cleaning lips of the cleaning element 846 scrape along the support surface of the fiberbeard support 807 so that dirt adhering there is scraped off.

Figure 9:
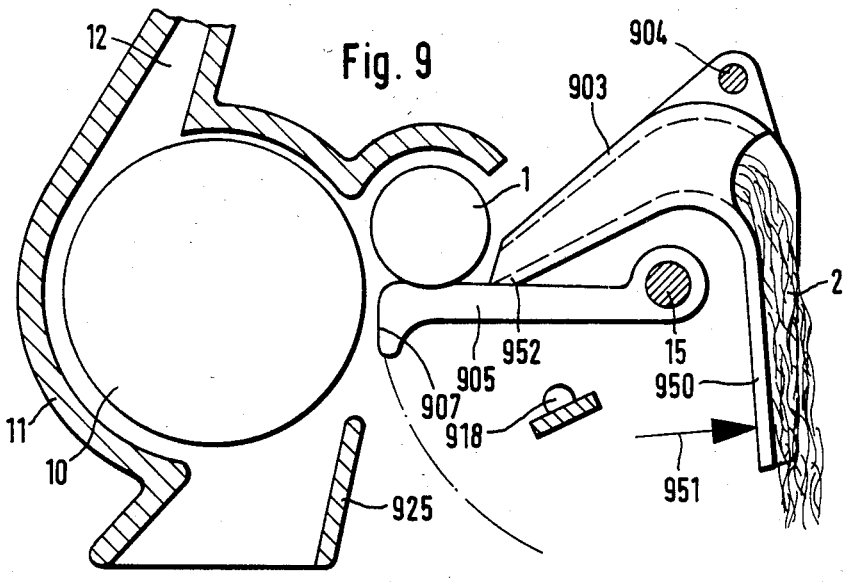
FIG. 9 is a schematic partial sectional lateral view of another embodiment of the invention having a feeding hopper serving as the actuating device for the guiding of the sliver loading part from the operating position to the cleaning position.

In the case of the embodiment according to FIG. 9, the end 952 of a feeding funnel 903 rests on the feeding table 905 serving as the sliver loading part and equipped with a fiberbeard support 907, the feeding funnel 903 being pivoted around a swivel shaft 904 extending in parallel to the swivel shaft 15 of the feeding table 905 but at a relatively large distance from it. The feeding funnel 903 is equipped with a relatively long, grip-type projection 950 which, especially by manual operation, can be swivelled in the direction of the Arrow 951. By means of the swivelling of the feeding funnel 903, the end 952 moves the feeding table 905 into its cleaning position in which it moves against a stop 918.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Apparatus for feeding sliver to an opening roller of an open-end spinning machine, comprising:

a feeding roller and a sliver loading means disposed adjacent one another to form a sliver clamping gap therebetween, said feeding roller and sliver loading means being operable to form a fiberbeard of sliver which is fed to the circumference of the opening roller, fiberbeard support means disposed opposite the circumference of the opening roller for supporting the fiberbeard as it is fed from the sliver clamping gap to the opening roller, and movable guide support means connected with the fiberbeard support means and being operable to move the fiberbeard support means between an operating position adjacent to the circumference of the opening roller to a cleaning position away from the operating position where the fiberbeard support means is accessible to a cleaning element for cleaning without requiring movement of the opening roller.

2. Apparatus according to claim 1, wherein the sliver loading means and fiberbeard support means are provided on a common sliver loading part, said movable guide support means being operable to move said common sliver loading part away from its operating position to its cleaning position.

3. Apparatus according to claim 2, wherein the common sliver loading part is pivoted around a shaft that is parallel to the shaft of the feeding roller, and wherein the pivoting angle between the operating position and the cleaning position swivelled away from the feeding roller and the opening roller is about 90°.

4. Apparatus according to claim 2, wherein the cleaning position of the common sliver loading part is limited by a stop.

5. Apparatus according to claim 2, wherein resilient means are provided for resiliently biasing the common sliver loading part toward the operating position, and wherein the resilient means for the sliver loading common part is supported and coupled to the sliver loading part in such a way that, during the swivelling it passes a dead center position between the operating position and the cleaning position.

6. Apparatus according to claim 5, wherein the resilient means is a spring said spring being arranged laterally next to the common part and separated by an intermediate wall from the fiber-carrying area of the common part.

7. Apparatus according to claim 6, wherein the spring for the common sliver loading part is a spiral spring that is applied to a swivel shaft with which the common sliver loading part is connected in a rotationally stable manner.

8. Apparatus according to claim 7, wherein a wall is provided in the transport direction of the fiber material behind the fiberbeard support means and opposite the circumference of the opening roller, said wall being held so that it can be moved away from the opening roller.

9. Apparatus according to claim 8, wherein the wall is mounted at the common sliver loading part and together with it, can be moved away from the opening roller.

10. Apparatus according to claim 8, wherein the wall is pivoted around a stationary shaft and by means of a spring element is pressed onto a swivelling element.

11. Apparatus according to claim 2, wherein, on the side of the common sliver loading part facing the feeding roller, between its swivel shaft and the feeding roller, a feeding funnel is supported that can be swivelled around a shaft that is parallel to the swivel shft, and is equipped with a lever-type gripping element.

12. Apparatus according to claim 2, wherein at least one stationary cleaning element is provided which is arranged in the path of movement of the support surface of the fiberbeard support means that can be moved away from the operating position to the cleaning position.

13. Apparatus according to claim 12, wherein the cleaning element has at least one elastic cleaning lip projecting approximately radially into the swivel path of the support surface of the fiberbeard support means.

14. Apparatus according to claim 2, wherein an automatic servicing device is provided which contains an adjusting element that can be selectively applied to the common sliver loading part.

15. Apparatus according to claim 14, wherein the common sliver loading part is connected in a rotationally stable manner with its swivel shaft, and wherein the swivel shaft is equipped with a driving element to which the adjusting element of the servicing device can be applied that can be driven to perform rotating movements.

16. Apparatus according to claim 15, wherein a hollow shaft having an internal square is used as the swivel shaft, into which the adjusting element of the servicing device that is equipped with a corresponding external square can be introduced.

17. Apparatus according to claim 14, wherein the automatic servicing device is equipped with at least one cleaning element that can be applied to the support surface of the fiberbeard support means when it is located in the cleaning position.

18. Apparatus according to claim 14, wherein resilient means are provided for resiliently biasing the common part toward the operating position, and wherein the resilient means for the sliver loading common part is supported and coupled to the common part in such a way that, during the swivelling it passes a dead center position between the operating position and the cleaning position.

19. Apparatus according to claim 18, wherein the automatic servicing device is equipped with at least one cleaning element that can be applied to the support surface of the fiberbeard support means when it is located in the cleaning position.

* * * * *